US010488818B2

(12) United States Patent
Yamashita et al.

(10) Patent No.: US 10,488,818 B2
(45) Date of Patent: Nov. 26, 2019

(54) COOLING UNIT FOR AN IMAGE FORMING APPARATUS

(71) Applicant: KYOCERA Document Solutions Inc., Osaka (JP)

(72) Inventors: Kazuya Yamashita, Osaka (JP); Yoshiaki Ikebata, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/203,305

(22) Filed: Nov. 28, 2018

(65) Prior Publication Data

US 2019/0163124 A1 May 30, 2019

(30) Foreign Application Priority Data

Nov. 30, 2017 (JP) ..... 2017-230358

(51) Int. Cl.
*G03G 21/20* (2006.01)
*G03G 15/08* (2006.01)

(52) U.S. Cl.
CPC ..... *G03G 21/206* (2013.01); *G03G 15/0806* (2013.01); *G03G 15/0887* (2013.01); *G03G 2221/1645* (2013.01)

(58) Field of Classification Search
CPC ..... G03G 21/206; G03G 15/0806; G03G 15/0887; G03G 2221/1645; G03G 21/20
See application file for complete search history.

(56) References Cited

U.S. PATENT DOCUMENTS

2005/0168222 A1* 8/2005 Arz ..... G01R 33/3856 324/318
2010/0008695 A1* 1/2010 Okano ..... G03G 21/20 399/94
2010/0129107 A1* 5/2010 Takehara ..... G03G 21/206 399/92
2012/0227927 A1* 9/2012 Fujiya ..... F28D 15/00 165/11.1
2012/0263491 A1* 10/2012 Fujiya ..... G03G 21/206 399/94
2014/0308057 A1* 10/2014 Tomino ..... G03G 15/2017 399/341
2016/0026113 A1* 1/2016 Takahashi ..... G03G 15/0806 399/285

FOREIGN PATENT DOCUMENTS

JP 2010-244010 A 10/2010

* cited by examiner

*Primary Examiner* — Sandra Brase
(74) *Attorney, Agent, or Firm* — Studebaker & Brackett PC

(57) ABSTRACT

An image forming apparatus includes a photosensitive drum, a development section, and a cooling unit. An electrostatic latent image is formed on the photosensitive drum. The development section supplies toner to the electrostatic latent image to form a toner image. The cooling unit cools the development section. The cooling unit includes a heat receiving section, a heat radiating section, and a cooling tube. The heat receiving section receives heat from the development section. The heat radiating section radiates the heat received by the heat receiving section. The cooling tube returns a liquid coolant sent from the heat radiating section to the heat radiating section by way of the heat receiving section. The heat receiving section has a groove structure into which the cooling tube is fitted.

12 Claims, 7 Drawing Sheets

COOLING UNIT FOR AN IMAGE FORMING APPARATUS

INCORPORATION BY REFERENCE

The present application claims priority under 35 U.S.C. § 119 to Japanese Patent Application No. 2017-230358, filed on Nov. 30, 2017. The contents of this application are incorporated herein by reference in their entirety.

BACKGROUND

The present disclosure relates to an image forming apparatus.

An image forming apparatus includes a developing unit and a cooling unit. The cooling unit cools the developing unit. The cooling unit includes a heat receiving section, a cooling section, a circulation pipe, a cooling pump, and a reserve tank. The heat receiving section presses against a wall of the developing unit and receives heat from the developing unit. The cooling section cools a liquid coolant. The liquid coolant flows through the circulation pipe. The cooling pump circulates the liquid coolant within the circulation pipe. The reserve tank stores the liquid coolant. The heat receiving section has a heat receiving section main body with a flow channel provided therein. The liquid coolant flows through the flow channel. The heat receiving main body and the flow channel are each made of a metal material such as copper or aluminum. The circulation pipe is connected to an end of the flow channel.

SUMMARY

An image forming apparatus according to an aspect of the present disclosure includes a photosensitive drum, a development section, and a cooling unit. An electrostatic latent image is to be formed on the photosensitive drum. The development section supplies toner to the electrostatic latent image to form a toner image. The cooling unit cools the development section. The cooling unit includes a heat receiving section, a heat radiating section, and a cooling tube. The heat receiving section receives heat from the development section. The heat radiating section radiates the heat received by the heat receiving section. The cooling tube returns a liquid coolant sent from the heat radiating section to the heat radiating section by way of the heat receiving section. The heat receiving section has a groove structure into which the cooling tube is fitted.

BRIEF DESCRIPTION OF THE DRAWINGS

FIG. 4A is a base view of the heat receiving section. FIG. 4B is a side view of the heat receiving section.

FIG. 6A is a base view of the heat receiving section. FIG. 6B is a side view of the heat receiving section.

FIG. 7A is a base view of the heat receiving section. FIG. 7B is a side view of the heat receiving section.

DETAILED DESCRIPTION

Embodiments of the present disclosure will be described as follows with reference to the accompanying drawings (FIGS. 1 to 7B). Note that elements within the drawings that are the same or equivalent will be labeled with the same reference signs and description thereof will not be repeated.

<Common Configuration of First to Third Embodiments>

Figure 1:
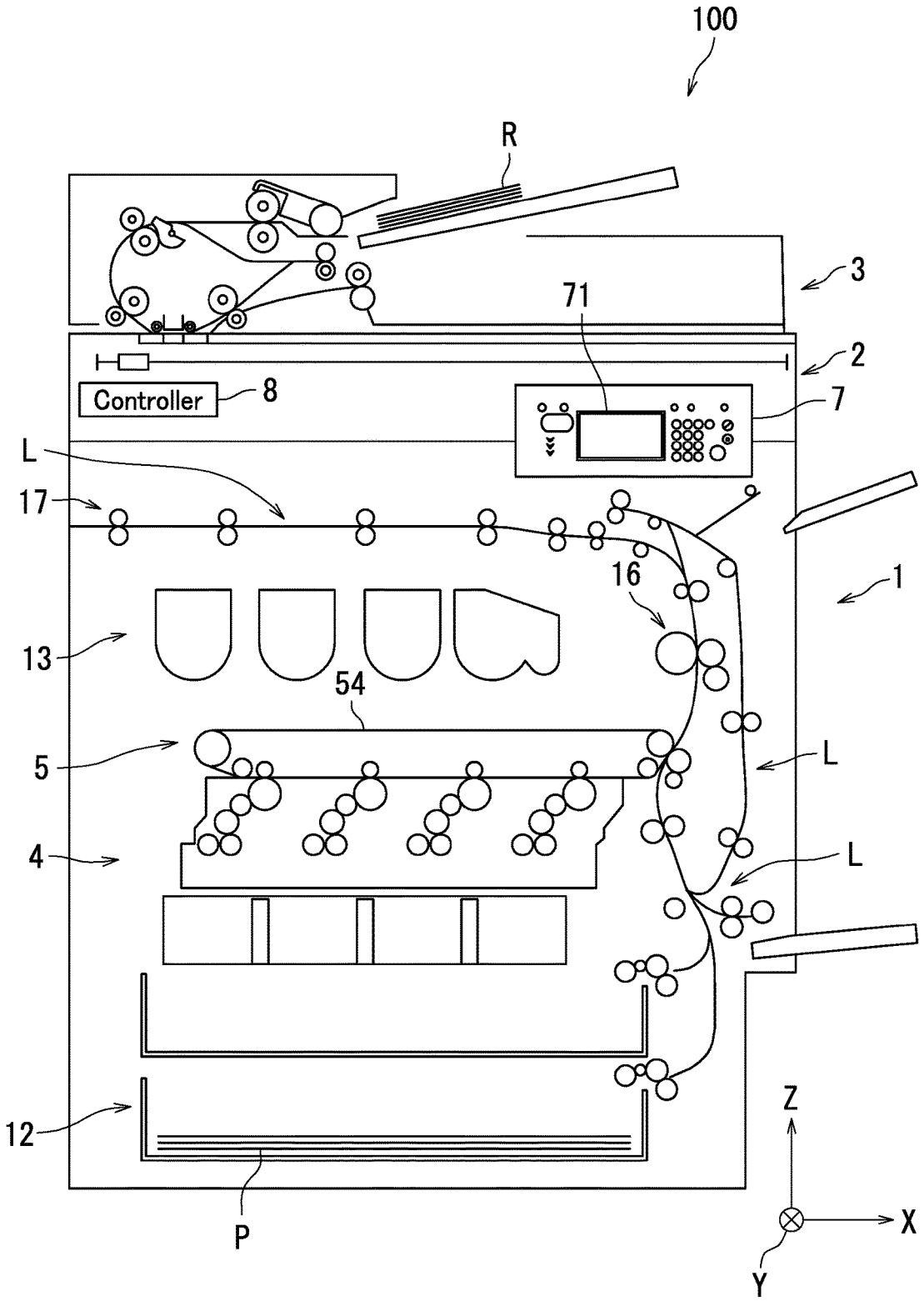
FIG. 1 is a diagram illustrating a configuration of an image forming apparatus according to embodiments of the present disclosure.

First, a configuration of an image forming apparatus 100 according to the embodiments of the present disclosure will be described with reference to FIG. 1. FIG. 1 is a diagram illustrating the configuration of the image forming apparatus 100. The image forming apparatus 100 is a color multifunction peripheral.

As illustrated in FIG. 1, the image forming apparatus 100 includes an image forming unit 1, an image reading unit 2, a document conveyance unit 3, an operation display section 7, and a controller 8. The image forming unit 1 forms an image on paper P. The image reading unit 2 reads an image from a document R and generates image information. The document conveyance unit 3 conveys the document R to the image reading unit 2. The operation display section 7 receives an operation of a user. The controller 8 controls operation of the image forming apparatus 100.

Mutually orthogonal X, Y, and Z axes are shown in FIG. 1. The X and Y axes are parallel to a horizontal plane. The Z axis is parallel to a vertical direction. In the following description, a positive direction of the Y axis may be referred to as backward, and a negative direction of the Y axis may be referred to as forward.

The image forming unit 1 includes a feeding section 12, a conveyance section L, a toner supply section 13, an image forming section 4, a fixing section 16, and an ejection section 17. The image forming section 4 includes a transfer section 5.

The feeding section 12 feeds the paper P to the conveyance section L. The conveyance section L conveys the paper P to the ejection section 17 by way of the transfer section 5 and the fixing section 16.

Toner containers are attached to the toner supply section 13. Each toner container supplies a toner to the image forming section 4. The image forming section 4 forms an image on the paper P. A configuration of the image forming section 4 will be described later in detail with reference to FIG. 2.

The transfer section 5 includes an intermediate transfer belt 54. The image forming section 4 transfers cyan, magenta, yellow, and black toner images on to the intermediate transfer belt 54. The toner images of the respective colors are superimposed onto the intermediate transfer belt 54, thus forming an image on the intermediate transfer belt 54. The transfer section 5 transfers the image formed on the intermediate transfer belt 54 onto the paper P. As a result, an image is formed on the paper P.

The fixing section 16 applies heat and pressure to the paper P, thus fixing the image formed on the paper P to the paper P. The ejection section 17 ejects the paper P out of the image forming apparatus 100.

The operation display section 7 includes a touch panel 71. The touch panel 71 includes a liquid-crystal display (LCD), for example, and displays various images. The touch panel 71 also includes a touch sensor and receives an operation from the user.

The controller 8 includes a processor and storage. The processor includes a central processing unit (CPU), for example. The storage includes memory such as semiconductor memory, and may include a hard disk drive (HDD). The storage stores a control program.

Figure 2:
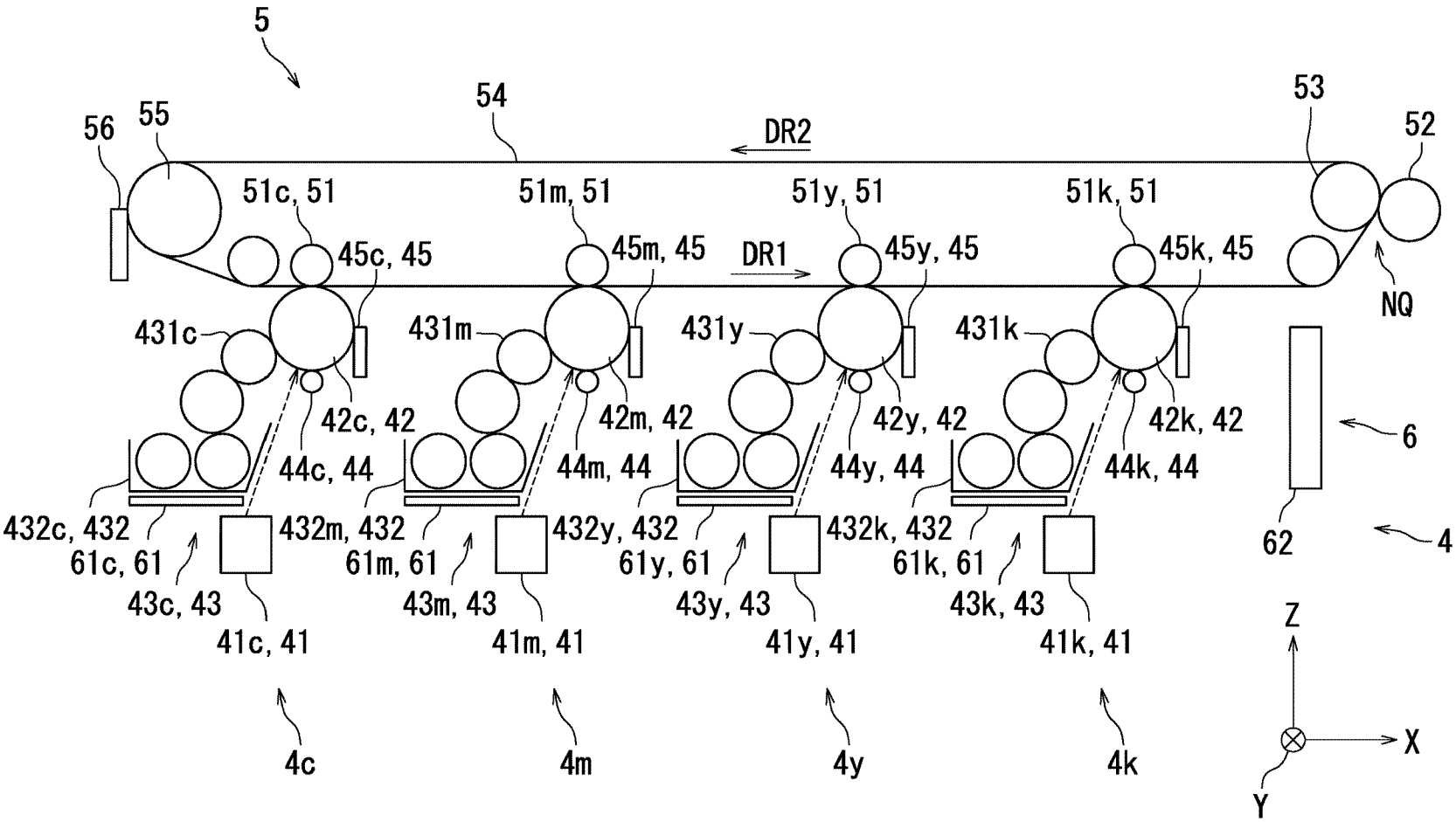
FIG. 2 is a diagram illustrating a configuration of an image forming section according to the embodiments of the present disclosure.

Next, the configuration of the image forming section 4 according to the embodiments of the present disclosure will be described with reference to FIGS. 1 and 2. FIG. 2 is a diagram illustrating an example of the configuration of the image forming section 4. As illustrated in FIG. 2, the image forming section 4 includes an image forming section 4*c*, and image forming section 4*m*, and image forming section 4*y*, and an image forming section 4*k*. The image forming apparatus 100 further includes a cooling unit 6.

The image forming section 4*c*, the image forming section 4*m*, the image forming section 4*y*, and the image forming section 4*k* each include an exposure section 41, a photosensitive drum 42, a development section 43, a charging roller 44, and a cleaning blade 45. The development section 43 includes a development roller 431. The image forming section 4*c*, the image forming section 4*m*, the image forming section 4*y*, and the image forming section 4*k* have substantially the same configuration aside from being supplied different color toners. Accordingly, the configuration of the image forming section 4*c* to which a cyan toner is supplied will be described in the following, and description of the configuration with respect to the image forming section 4*m*, the image forming section 4*y*, and the image forming section 4*k* will be omitted. The photosensitive drum 42 is equivalent to an example of an "image bearing member".

The image forming section 4*c* includes an exposure section 41*c* (41), a photosensitive drum 42*c* (42), a development section 43*c* (43), a charging roller 44*c* (44), and a cleaning blade 45*c* (45).

The charging roller 44*c* charges the photosensitive drum 42*c* to a predetermined potential. The exposure section 41*c* radiates laser light to expose the photosensitive drum 42*c*, thus forming an electrostatic latent image on the photosensitive drum 42*c*. The development section 43*c* includes a development roller 431*c* (431). The development roller 431*c* supplies the cyan toner to the photosensitive drum 42*c* and develops the electrostatic latent image to form a toner image. Thus, a cyan toner image is formed on a peripheral surface of the photosensitive drum 42*c*.

The development section 43*c* further includes a housing section 432*c* (432). The housing section 432*c* houses the development roller 431*c* and the toner. The toner from the toner container is supplied to the housing section 432*c*.

A distal end (upper end in FIG. 2) of the cleaning blade 45*c* slides on the peripheral surface of the photosensitive drum 42*c*. The cyan toner remaining on the peripheral surface of the photosensitive drum 42*c* is removed by the distal end of the cleaning blade 45*c* sliding on the peripheral surface of the photosensitive drum 42*c*.

The transfer section 5 transfers the toner image onto the paper P. The transfer section 5 includes primary transfer rollers 51, a secondary transfer roller 52, a drive roller 53, the intermediate transfer belt 54, and a driven roller 55. The primary transfer rollers 51 transfer the cyan, magenta, yellow, and black toner images from the photosensitive drums 42 to the intermediate transfer belt 54. The primary transfer rollers 51 include a primary transfer roller 51*c*, a primary transfer roller 51*m*, a primary transfer roller 51*y*, and a primary transfer roller 51*k*.

The drive roller 53 drives the intermediate transfer belt 54. The intermediate transfer belt 54 is an endless belt which is stretched around the primary transfer rollers 51, the drive roller 53, and the driven roller 55. The intermediate transfer belt 54 is rotatably driven in a counterclockwise direction by the drive roller 53, as indicated by a direction DR1 and a direction DR2. The driven roller 55 is rotatably driven along with the rotation of the intermediate transfer belt 54. A blade 56 removes remaining toner from the surface of the intermediate transfer belt 54.

The secondary transfer roller 52 presses against the drive roller 53, and a nip part NQ is formed between the secondary transfer roller 52 and the drive roller 53. The secondary transfer roller 52 transfers the toner images on the intermediate transfer belt 54 to the paper P when the paper P passes through the nip part NQ.

The cooling unit 6 includes a heat receiving section 61*c*, a heat receiving section 61*m*, a heat receiving section 61*y*, a heat receiving section 61*k*, and a heat radiating section 62. The heat receiving section 61*c* receives heat from the development section 43*c*. The heat receiving section 61*m* receives heat from a development section 43*m*. The heat receiving section 61*y* receives heat from a development section 43*y*. The heat receiving section 61*k* receives heat from a development section 43*k*. The heat radiating section 62 radiates the heat received by the heat receiving section 61*c*, the heat receiving section 61*m*, the heat receiving section 61*y*, and the heat receiving section 61*k*. In the following description, the heat receiving section 61*c*, the heat receiving section 61*m*, the heat receiving section 61*y*, and the heat receiving section 61*k* may each be referred to as a heat receiving section 61.

Each heat receiving section 61 is located so as to be in contact with a base surface of the corresponding housing section 432. The heat radiating section 62 is located downstream of the image forming section 4*k* in the direction DR1. In other words, the heat radiating section 62 is located beneath the drive roller 53. Each heat receiving section 61 includes a groove structure. A cooling tube is fitted into the groove structure. The cooling tube will be described later in detail with reference to FIG. 3. The groove structure will be described later in detail with reference to FIGS. 4 to 7.

Figure 3:
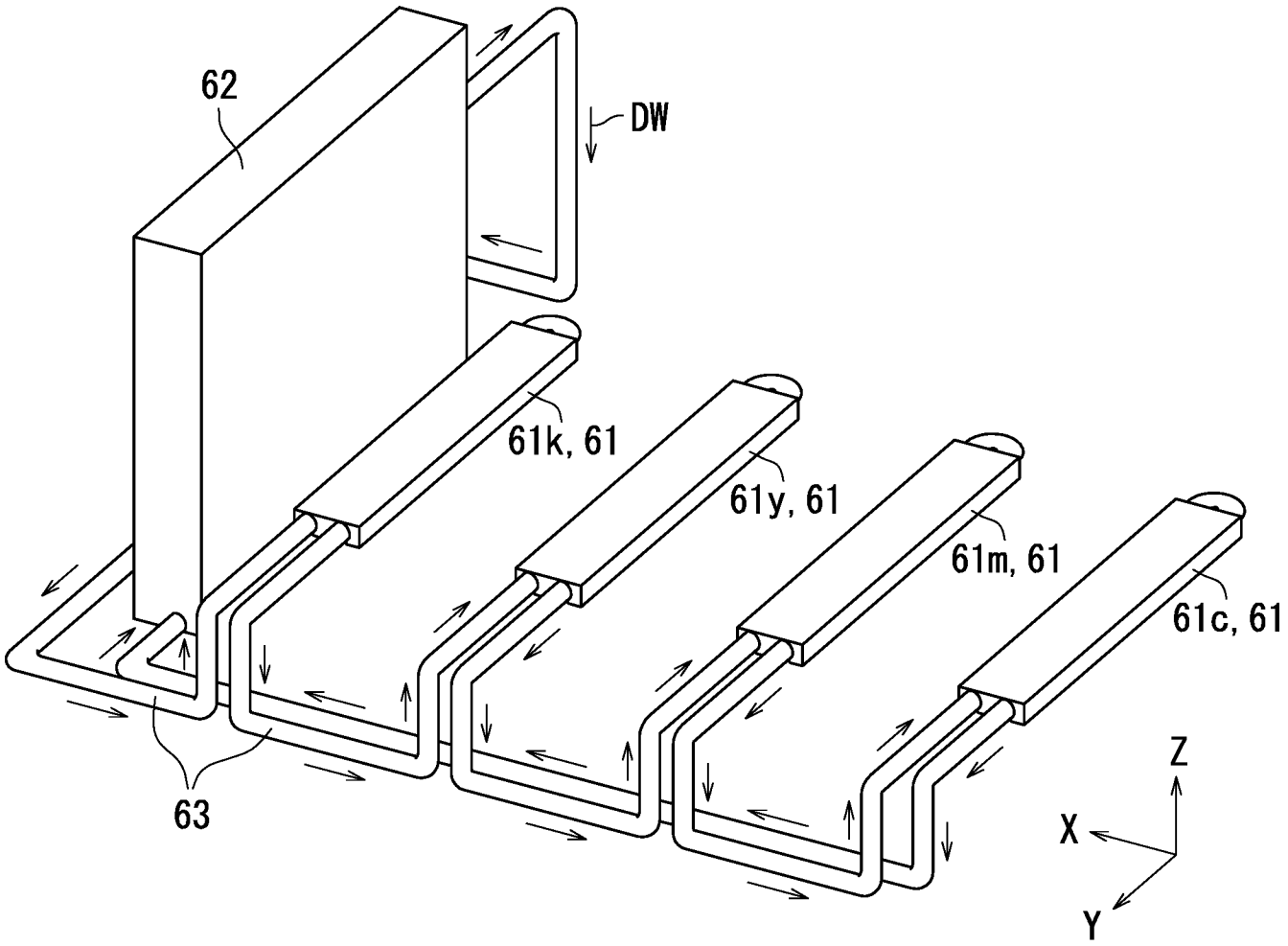
FIG. 3 is a diagram illustrating a configuration of a cooling unit according to the embodiments of the present disclosure.

Next, a configuration of the cooling unit 6 according to the embodiments of the present disclosure will be described with reference to FIGS. 1 and 3. FIG. 3 is a diagram illustrating the configuration of the cooling unit 6. The cooling unit 6 further includes a cooling tube 63.

The cooling tube 63 returns a liquid coolant sent from the heat radiating section 62 to the heat radiating section 62 by way of the heat receiving sections 61. The cooling tube 63 carries the liquid coolant in a direction DW, for example. Specifically, the cooling tube 63 causes the liquid coolant sent from the heat radiating section 62 to flow into the heat receiving section 61*k*. The cooling tube 63 then causes the liquid coolant sent from the heat receiving section 61*k* to flow into the heat receiving section 61*y*. The cooling tube 63 further causes the liquid coolant sent from the heat receiving section 61*y* to flow into the heat receiving section 61*m*. The cooling tube 63 then causes the liquid coolant sent from the heat receiving section 61*m* to flow into the heat receiving section 61*c*. The cooling tube 63 further returns the liquid coolant sent from the heat receiving section 61*c* to the heat radiating section 62.

The cooling tube 63 is elastic. The cooling tube 63 is made of resin, for example. The cooling tube 63 also includes a thermally conductive filler. The cooling tube 63 has a thermal conductivity equal to or greater than 1 W/(m·K).

For example, the cooling tube 63 is created by combining a base rubber, the thermally conductive filler, and a softener. The base rubber is made by combining 70 to 95 parts by mass of an acrylic rubber (trade name NIPOL AR54 produced by Zeon Corporation) with 5 to 30 parts by mass of a thermoplastic elastomer (trade name SEPTON (registered Japanese trademark) 4055 produced by Kuraray Co., Ltd.).

At least one of the following is added as the thermally conductive filler: aluminum oxide A (trade name AH35-2 produced by Micron Co., Ltd.), aluminum oxide B (trade name AS-20 produced by Showa Denko K. K.), and aluminum hydroxide (trade name NIPPON LIGHT METAL B-103 produced by Nippon Light Metal Company, Ltd.).

Oil C (trade name ADEKA CIZER (registered Japanese trademark) RS700 produced by ADEKA Corporation) and Oil D (trade name DIANA (registered Japanese trademark) PROCESS OIL PW380 produced by Idemitsu Kosan Co., Ltd.) are each added as the softener.

For example, 85 parts by mass of the acrylic rubber is combined with 15 parts by mass of the thermoplastic elastomer to create the base rubber. Then, 800 parts by mass of the aluminum oxide B and 200 parts by mass of the aluminum hydroxide are added, and 130 parts by mass of the oil C and 30 parts by mass of the oil D are added. As a result, a thermally conductive rubber with a thermal conductivity of 1.63 W/(m·K) is obtained.

As described above with reference to FIGS. 1 to 3, the cooling tube 63 can easily fit into the groove structures of the heat receiving sections 61 because the cooling tube 63 is elastic in the embodiments of the present disclosure. Accordingly, the cooling unit 6 can be easily produced.

The cooling tube 63 is made of resin. Accordingly, the cooling unit 6 can be produced cheaply as compared to a case in which the cooling tube 63 is made of a metal material such as aluminum or copper.

Furthermore, the cooling tube 63 includes a thermally conductive filler. Consequently, the cooling tube 63 can have an increased thermal conductivity. Accordingly, heat of the development sections 43 can be efficiently transferred to the liquid coolant in the heat receiving sections 61. As a result, the development sections 43 can be efficiently cooled.

The cooling tube 63 has a thermal conductivity equal to or greater than 1 W/(m·K). Therefore, the heat of the development sections 43 can be efficiently transferred to the liquid coolant in the heat receiving sections 61. Accordingly, the development sections 43 can be efficiently cooled.

<First Embodiment>

Figure 4A:
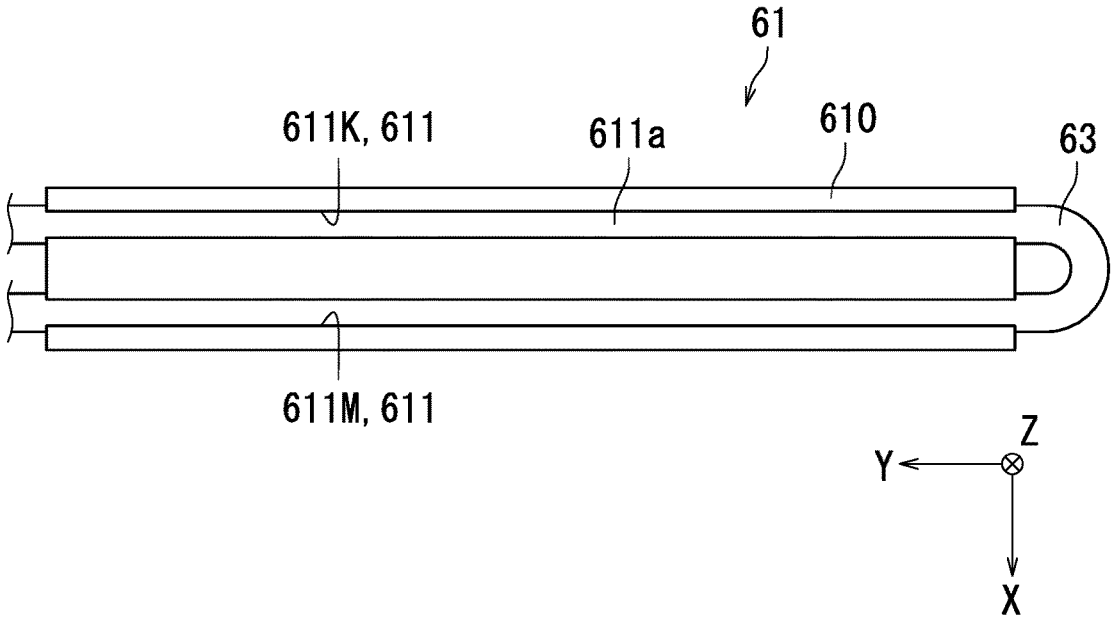
FIGS. 4A and 4B are diagrams illustrating a configuration of a heat receiving section according to a first embodiment.
Figure 4B:
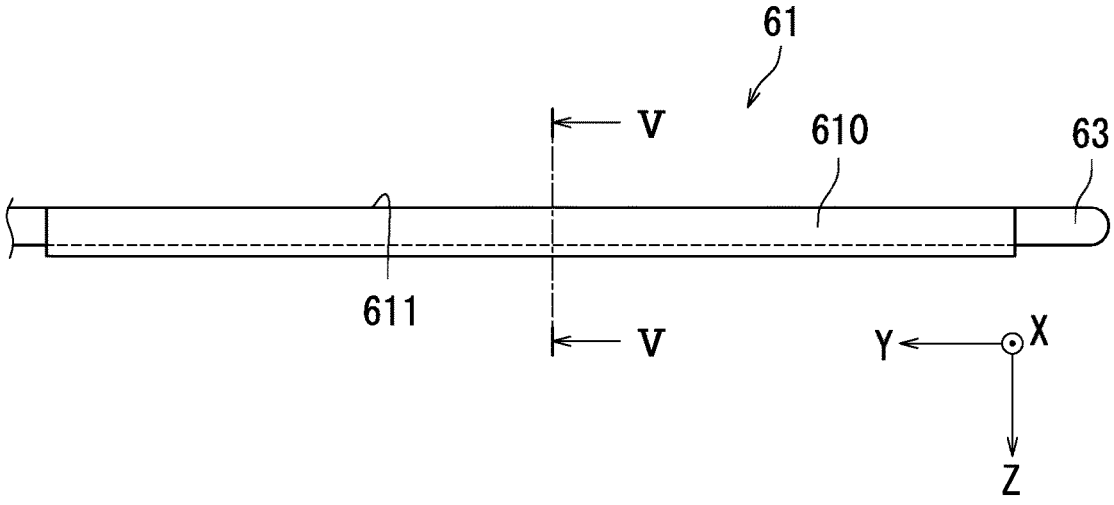

Next, a configuration of each heat receiving section 61 according to a first embodiment of the present disclosure will be described with reference to FIGS. 1 to 5. FIGS. 4A and 4B are diagrams illustrating the configuration of a heat receiving section 61. FIG. 4A is a base view of the heat receiving section 61. FIG. 4B is a side view of the heat receiving section 61.

As illustrated in FIG. 4A, the heat receiving section 61 has a heat receiving section main body 610 and two groove structures 611. The heat receiving section main body 610 is made of a metal material such as aluminum or copper, and has a shape of a rectangular plate.

A long side of the heat receiving section main body 610 extends along the Y axis. A short side of the heat receiving section main body 610 extends along the X axis. That is, upper and base surfaces of the heat receiving section main body 610 are each arranged along an X-Y plane. The upper surface of the heat receiving section main body 610 is in contact with the base surface of the corresponding housing section 432. That is, the heat receiving section 61 receives heat of the corresponding development section 43 from the upper surface of the heat receiving section main body 610.

The two groove structures 611 are each arranged along the Y axis. The cooling tube 63 is fitted into the groove structures 611. The two groove structures 611 are a groove structure 611K and a groove structure 611M. The groove structure 611K is on a negative side of the heat receiving section main body 610 with respect to the X axis. The groove structure 611M is on a positive side of the heat receiving section main body 610 with respect to the X axis.

The cooling tube 63 is arranged in the groove structure 611K such that the liquid coolant flows from a positive end of the heat receiving section main body 610 with respect to the Y axis toward a negative end of the heat receiving section main body 610 with respect to the Y axis. The cooling tube 63 protrudes from the negative end of the heat receiving section main body 610 with respect to the Y axis and is bent in a U-shape. Then, the cooling tube 63 is arranged in the groove structure 611M such that the liquid coolant flows from the negative end of the heat receiving section main body 610 with respect to the Y axis toward the positive end of the heat receiving section main body 610 with respect to the Y axis. The positive end with respect to the Y axis is equivalent to an example of an "end portion on one side", and the negative end with respect to the Y axis is equivalent to an example of an "end portion on an opposite side".

As illustrated in FIG. 4B, the cooling tube 63 is located on the base surface (negative side with respect to the Z axis) of the heat receiving section main body 610. Specifically, the cooling tube 63 is located flush to the base surface of the heat receiving section main body 610.

Figure 5:
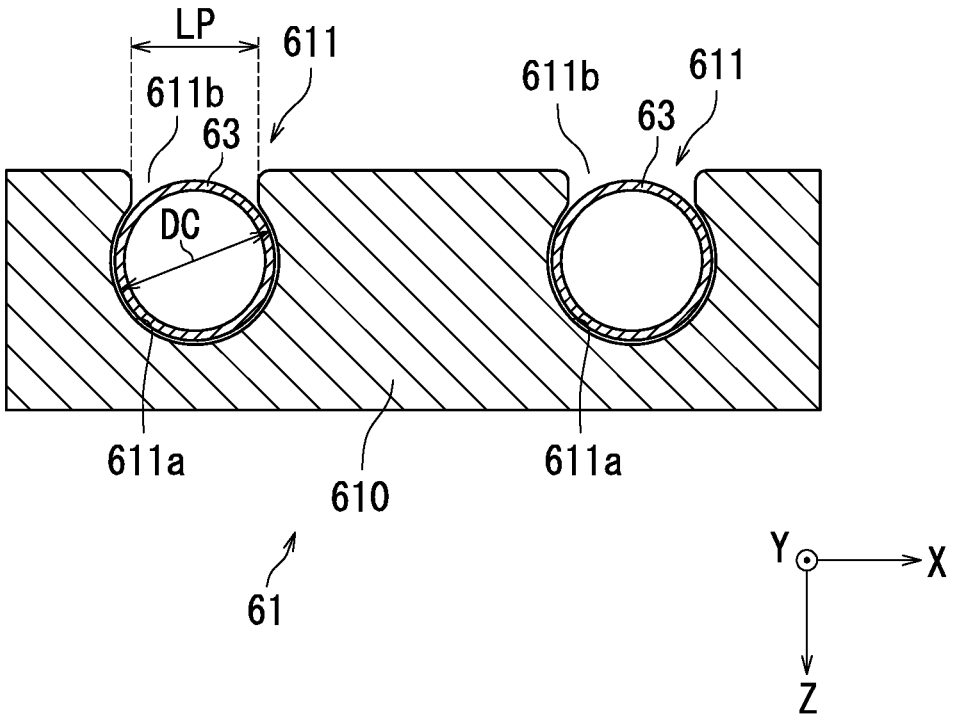
FIG. 5 is a cross-sectional view illustrating the heat receiving section in the first embodiment.

FIG. 5 is a cross-sectional view of the heat receiving section 61 illustrating a cross section taken along line V-V in FIG. 4B. As illustrated in FIG. 5, each of the groove structures 611 has an arc shape 611*a* in the cross-sectional view. The arc shape 611*a* has an opening 611*b* in one direction in the cross-sectional view. A diameter DC of the arc shape 611*a* is smaller than an outer diameter of the cooling tube 63 by a predetermined length. The predetermined length is 0.1 mm, for example. A span LP of the opening 611*b* in the cross section of the heat receiving section 61 is smaller than the outer diameter of the cooling tube 63.

As described above with reference to FIGS. 1 to 5, the cooling tube 63 is fitted into the groove structures 611 of the heat receiving section 61 in the first embodiment of the present disclosure, thus allowing the cooling unit 6 to be produced cheaply.

Each of the groove structures 611 has the arc shape 611*a* with the opening 611*b* in one direction in the cross-sectional view. Therefore, the cooling tube 63 can easily fit into the groove structure 611 through the opening 611*b*. Accordingly, the cooling unit 6 can be easily produced.

Furthermore, the diameter DC of the arc shape 611*a* is smaller than the outer diameter of the cooling tube 63 by a predetermined length. Consequentially, the diameter DC increases sliding resistance between the arc shape 611*a* and the cooling tube 63. Accordingly, the cooling tube 63 can be reliably fixed by the groove structures 611. Also, pressing force acts between the arc shape 611*a* and the cooling tube 63. Therefore, heat is easily transferred between the arc shape 611*a* and the cooling tube 63. Accordingly, cooling efficiency of the cooling unit 6 can be improved.

The span LP of the opening 611*b* in the cross section of the heat receiving section 61 is smaller than the outer diameter of the cooling tube 63. Accordingly, the cooling tube 63 can be more reliably fixed by the groove structures 611.

Furthermore, the cooling tube 63 is arranged so that the liquid coolant flows from the end portion on the one side of the heat receiving section main body 610 toward the end portion on the opposite side of the heat receiving section main body 610. The cooling tube 63 is also arranged to protrude from the end portion on the opposite side of the heat receiving section main body 610 and bend in a protruding portion thereof. The cooling tube 63 is also arranged so that the liquid coolant flows from the end portion on the opposite side of the heat receiving section main body 610 toward the end portion on the one side of the heat receiving section main body 610. Accordingly, the heat receiving section main body 610 can be efficiently cooled.

Note that in the first embodiment of the present disclosure, the heat receiving section 61 has two groove structures 611, but the first embodiment of the present disclosure is not limited as such. The heat receiving section 61 need only have one or more groove structures. For example, the heat receiving section 61 may have only one groove structure. For another example, the heat receiving section 61 may have three or more groove structures.

Also in the first embodiment of the present disclosure, the cooling unit 6 includes four heat receiving sections 61 (heat receiving section 61*k*, heat receiving section 61*y*, heat receiving section 61*m*, and heat receiving section 61*c*), but the present disclosure is not limited as such. For example, the cooling unit 6 may have only one heat receiving section 61. Specifically, the one heat receiving section 61 cools the four development sections 43 (development section 43*k*, development section 43*y*, development section 43*m*, and development section 43*c*). In this case, the configuration of the cooling unit 6 can be simplified. The one heat receiving section 61 is equivalent to an example of "one member". For another example, the cooling unit 6 may have only two heat receiving sections 61. Specifically, one heat receiving section 61 of the two heat receiving sections 61 cools two of the development sections 43 (development section 43*k* and development section 43*y*), and the other heat receiving section 61 of the two heat receiving sections 61 cools two of the development sections 43 (development section 43*m* and development section 43*c*). Four is equivalent to an example of a "predetermined number".

<Second Embodiment>

Figure 6A:
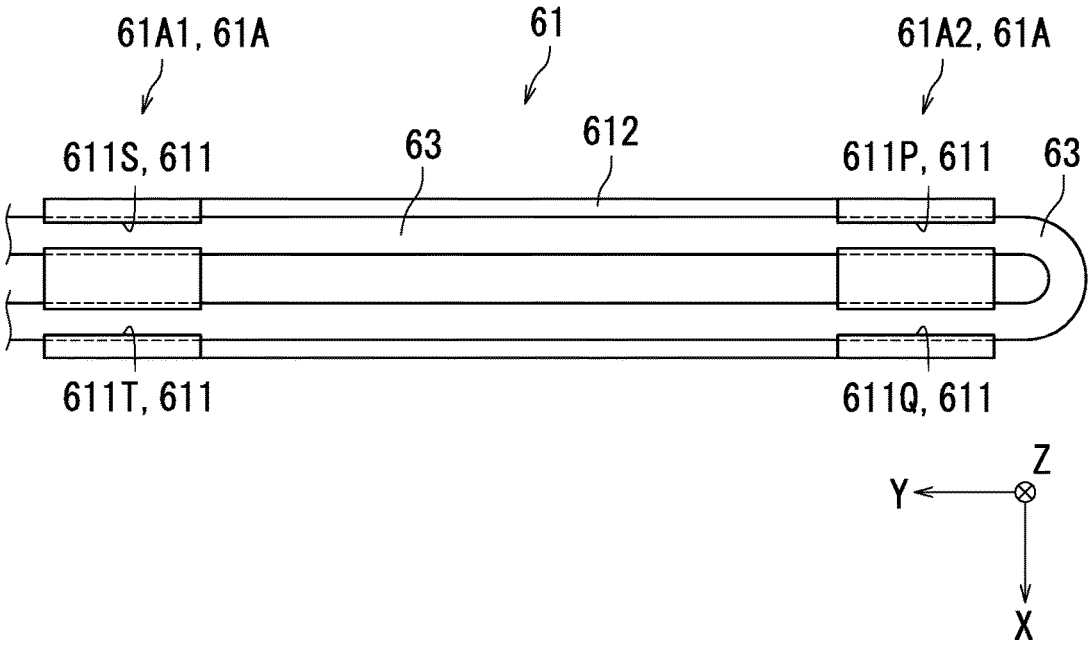
FIGS. 6A and 6B are diagrams illustrating a configuration of the heat receiving section according to a second embodiment.
Figure 6B:
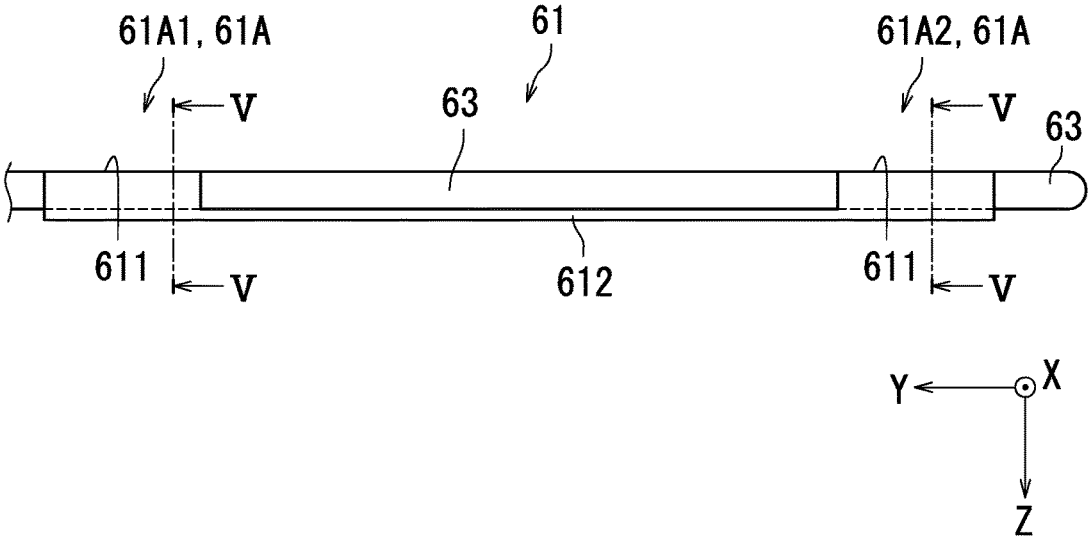

Next, a configuration of each heat receiving section 61 according to a second embodiment of the present disclosure will be described with reference to FIGS. 1 to 3, 5, 6A, and 6B. FIGS. 6A and 6B are diagrams illustrating the configuration of a heat receiving section 61 according to the second embodiment. FIG. 6A is a base view of the heat receiving section 61. FIG. 6B is a side view of the heat receiving section 61. As compared to the heat receiving section 61 according to the first embodiment, the heat receiving section 61 according to the second embodiment differs by having two fixing members 61A. In the following, points of difference between the heat receiving sections 61 according to the first and second embodiments will be mainly described.

As illustrated in FIGS. 6A and 6B, the heat receiving section 61 has a heat receiving section main body 612 and the two fixing members 61A. The heat receiving section main body 612 is made of a metal material such as aluminum or copper, and has a shape of a rectangular plate.

A long side of the heat receiving section main body 612 extends along the Y axis. A short side of the heat receiving section main body 612 extends along the X axis. That is, upper and base surfaces of the heat receiving section main body 612 are each arranged along the X-Y plane. The upper surface of the heat receiving section main body 612 is in contact with the base surface of the corresponding housing section 432. That is, the heat receiving section 61 receives heat of the corresponding development section 43 from the upper surface of the heat receiving section main body 612.

The two fixing members 61A of the heat receiving section 61 are arranged in a longitudinal direction (along the Y axis) of the heat receiving section 61 with a gap therebetween. Specifically, the two fixing members 61A are respectively located on opposite end portions of the heat receiving section main body 612 with respect to the Y axis. The two fixing members 61A are a fixing member 61A1 and a fixing member 61A2. The fixing member 61A1 is located on a positive end of the heat receiving section main body 612 with respect to the Y axis, and the fixing member 61A2 is located on a negative end of the heat receiving section main body 612 with respect to the Y axis.

The two fixing members 61A are each integrated with the heat receiving section main body 612. The two fixing members 61A are each made of a metal material such as aluminum or copper, and have shapes of rectangular plates.

The two fixing members 61A each have two groove structures 611. Specifically, a cross section of each of the two fixing members 61A taken along line V-V is the same as the cross section of the heat receiving section 61 taken along line V-V according to the first embodiment illustrated in FIG. 5. Each of the groove structures 611 is arranged along the Y axis. The cooling tube 63 is fitted into the groove structures 611.

Also as illustrated in FIG. 5, each of the groove structures 611 has an arc shape 611*a* in the cross-sectional view. The arc shape 611*a* has an opening 611*b* in one direction in the cross-sectional view. A diameter DC of the arc shape 611*a* substantially matches the outer diameter of the cooling tube 63. A span LP of the opening 611*b* in the cross section of the heat receiving section 61 is smaller than the outer diameter of the cooling tube 63.

The fixing member 61A1 has a groove structure 611S and a groove structure 611T. The groove structure 611S is located on a negative side of the fixing member 61A1 with respect to the X axis. The groove structure 611T is located on a positive side of the fixing member 61A1 with respect to the X axis. The fixing member 61A2 has a groove structure 611P and a groove structure 611Q. The groove structure 611P is located on a negative side of the fixing member 61A2 with respect to the X axis. The groove structure 611Q is located on a positive side of the fixing member 61A2 with respect to the X axis.

The cooling tube 63 is arranged in the groove structure 6115 of the fixing member 61A1 from a positive end of the fixing member 61A1 with respect to the Y axis toward a negative end with respect to the Y axis. Then, the cooling tube 63 protrudes from the negative end of the groove structure 6115 with respect to the Y axis and is arranged along the base surface of the heat receiving section main body 612. Furthermore, the cooling tube 63 is arranged in the groove structure 611P of the fixing member 61A2 from a positive end of the fixing member 61A2 with respect to the Y axis toward a negative end with respect to the Y axis. Then, the cooling tube 63 protrudes from the negative end of the groove structure 611P with respect to the Y axis and is bent in a U-shape.

The cooling tube 63 is arranged in the groove structure 611Q of the fixing member 61A2 from the negative end of the fixing member 61A2 with respect to the Y axis to the positive end with respect to the Y axis. Then, the cooling tube 63 protrudes from the positive end of the groove structure 611Q with respect to the Y axis and is arranged along the base surface of the heat receiving section main body 612. Furthermore, the cooling tube 63 is arranged in the groove structure 611T of the fixing member 61A1 from the negative end of the fixing member 61A1 with respect to the Y axis toward the positive end with respect to the Y axis. Then, the cooling tube 63 protrudes from the positive end of the groove structure 611T with respect to the Y axis.

In the second embodiment of the present disclosure as described above with reference to FIGS. 1 to 3, 5, 6A, and 6B, the heat receiving section 61 has two fixing members 61A arranged in the longitudinal direction of the heat receiving section 61. Also, the groove structures 611 are included in each of the two fixing members 61A. Therefore, the cooling tube 63 can be fixed using the groove structures 611 included in each of the two fixing members 61A. Also, as compared to the heat receiving section 61 according to the first embodiment, the length of the groove structures 611 with respect to the Y axis is short. Accordingly, work required for processing to create the groove structures 611 can be reduced. As a result, the cooling unit 6 can be produced more cheaply.

Note that in the second embodiment of the present disclosure, the heat receiving section 61 has two fixing members 61A arranged in the longitudinal direction of the heat receiving section 61, but the second embodiment of the present disclosure is not limited as such. The heat receiving section 61 need only have a plurality of fixing members 61A arranged in the longitudinal direction of the heat receiving section 61. For example, the heat receiving section 61 may have three fixing members 61A arranged in the longitudinal direction of the heat receiving section 61. As the number of fixing members 61A increases, the cooling tube 63 can be more reliably fixed. Also, as the length of the groove structures 611 decreases, the work required for processing to create the groove structures 611 can be reduced.

Also in the second embodiment of the present disclosure, the fixing members 61A each have two groove structures 611, but the second embodiment of the present disclosure is not limited as such. The fixing members 61A need only each have one or more groove structures. For example, the fixing members 61A may each have only one groove structure. For another example, the fixing members 61A may each have three or more groove structures.

<Third Embodiment>

Figure 7A:
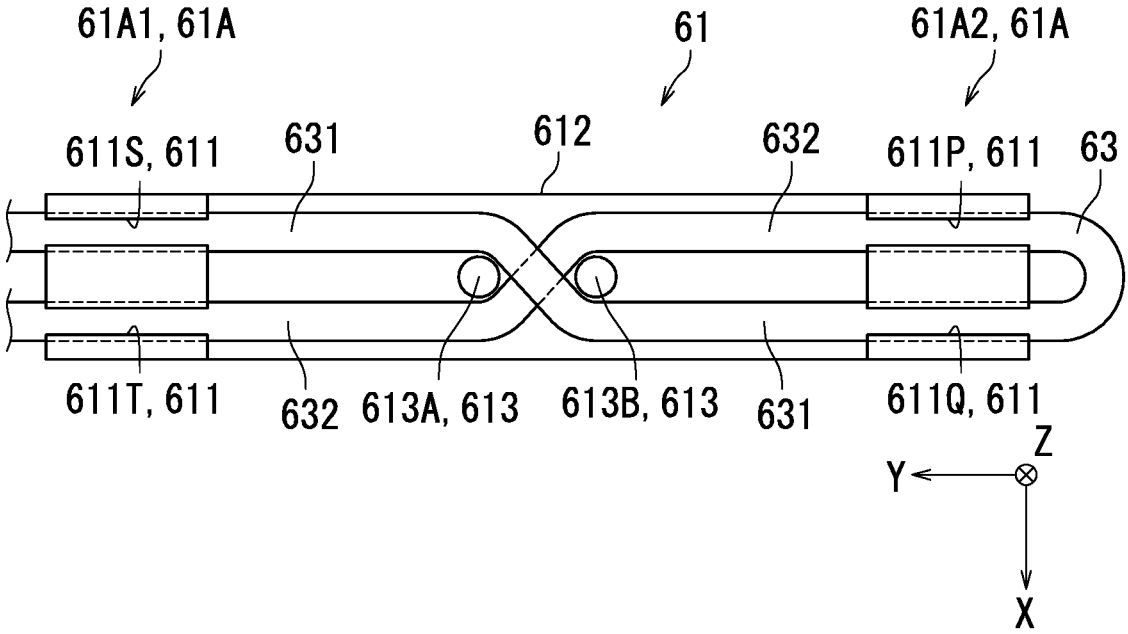
FIGS. 7A and 7B are diagrams illustrating a configuration of the heat receiving section according to a third embodiment.
Figure 7B:
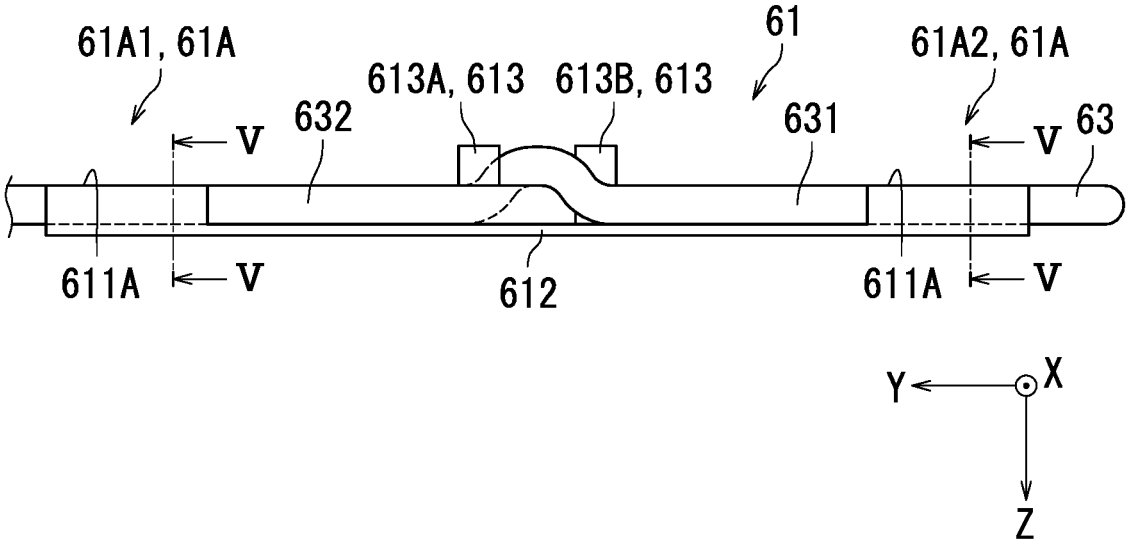

Next, a configuration of each heat receiving section 61 according to a third embodiment of the present disclosure will be described with reference to FIGS. 1 to 3, 5, 7A and 7B. FIGS. 7A and 7B are diagrams illustrating the configuration of a heat receiving section 61 according to the third embodiment. FIG. 7A is a base view of the heat receiving section 61. FIG. 7B is a side view of the heat receiving section 61. As compared to the heat receiving section 61 according to the second embodiment, the heat receiving section 61 according to the third embodiment differs by having guide members 613. In the following, points of difference between the heat receiving sections 61 according to the second and third embodiments will be mainly described.

As illustrated in FIGS. 7A and 7B, the heat receiving section 61 has a heat receiving section main body 612, two fixing members 61A, and a pair of guide members 613. The two fixing members 61A are a fixing member 61A1 and a fixing member 61A2.

Each of the guide members 613 establishes the position of the cooling tube 63. The cooling tube 63 bends around each of the guide members 613. Specifically, each of the guide members 613 is elongated in a negative direction of the Z axis on the heat receiving section main body 612. Each of the guide members 613 is cylindrical. The pair of guide members 613 is a guide member 613A and a guide member 613B. The guide member 613A is located farther in a positive direction of the Y axis than the guide member 613B.

As illustrated in FIG. 7A, the cooling tube 63 includes a cooling tube 631 and a cooling tube 632. The cooling tube 631 is a part of the cooling tube 63 located in a groove structure 611S of the fixing member 61A1. The cooling tube 632 is a part of the cooling tube 63 located in a groove structure 611T of the fixing member 61A1.

The guide member 613A bends the cooling tube 631 in a positive direction of the X axis, and bends the cooling tube 632 in a negative direction of the X axis. The guide member 613B bends the cooling tube 632 in the positive direction of the X axis, and bends the cooling tube 631 in the negative direction of the X axis.

The cooling tube 631 and the cooling tube 632 intersect between the guide member 613A and the guide member 613B. Specifically, the cooling tube 631 and the cooling tube 632 intersect between the guide member 613A and the guide member 613B with the cooling tube 631 being placed on a negative side of the cooling tube 632 with respect to the Z axis.

The cooling tube 631 is arranged in the groove structure 611S of the fixing member 61A1 from the positive end of the fixing member 61A1 with respect to the Y axis toward the negative end with respect to the Y axis. The cooling tube 631 then protrudes from the negative end of the groove structure 611S with respect to the Y axis and is arranged along the base surface of the heat receiving section main body 612. The cooling tube 631 is also bent in the positive direction of the X axis by the guide member 613A. The cooling tube 631 is further bent by the guide member 613B and is arranged along the Y axis.

The cooling tube 631 is arranged in a groove structure 611Q of the fixing member 61A2 from the positive end of the fixing member 61A2 with respect to the Y axis toward the negative end with respect to the Y axis. The cooling tube 63 then protrudes from the negative end of the groove structure 611Q with respect to the Y axis and is bent in a U-shape.

The cooling tube 632 is then arranged in a groove structure 611P of the fixing member 61A2 from the negative end of the fixing member 61A2 with respect to the Y axis toward the positive end with respect to the Y axis. The cooling tube 632 then protrudes from the positive end of the groove structure 611P with respect to the Y axis and is arranged along the base surface of the heat receiving section main body 612. The cooling tube 632 is also bent in the positive direction of the X axis by the guide member 613B. The cooling tube 632 is further bent by the guide member 613A and is arranged along the Y axis.

The cooling tube 632 is further arranged in the groove structure 611T of the fixing member 61A1 from the negative end of the fixing member 61A1 with respect to the Y axis toward the positive end with respect to the Y axis. The cooling tube 632 then protrudes from the negative end of the groove structure 611T with respect to the Y axis.

In the third embodiment of the present disclosure as described above with reference to FIGS. 1 to 3, 5, 7A, and 7B, the cooling tube 63 bends around the guide members 613. Therefore, the length of the cooling tube 63 located on the heat receiving section 61 can be lengthened. Accordingly, heat of the development section 43 can be more efficiently transferred to the liquid coolant in the heat receiving section 61.

Note that in the third embodiment of the present disclosure, the heat receiving section 61 has a pair of guide members 613, but the third embodiment of the present disclosure is not limited as such. The heat receiving section 61 need only have one or more guide members 613. For example, the heat receiving section 61 may have two or more pairs of guide members 613. The more pairs of guide members 613 the heat receiving section 61 has, the more the length of the cooling tube 63 located on the heat receiving section 61 can be lengthened. Accordingly, the heat of the development section 43 can be more efficiently transferred to the liquid coolant in the heat receiving section 61.

Also in the third embodiment of the present disclosure, the guide members 613 are cylindrical, but the third embodiment of the present disclosure is not limited as such. A guide member 613 need only establish the position of the cooling tube 63. For example, the guide member 613 may be an elongated plate-shaped rib on the heat receiving section main body 612.

The embodiments of the present disclosure have been described above with reference to the accompanying drawings. However, the present disclosure is not limited to the above-mentioned embodiments and may be implemented in various manners within a scope not departing from the gist thereof (as below in (1) and (2), for example). The drawings are schematic illustrations that emphasize elements of configuration in order to facilitate understanding thereof. Properties of the elements of configuration illustrated in the drawings, such as thickness, length, and number thereof, may differ from actual properties thereof in order to facilitate preparation of the drawings. Properties of the elements of configuration illustrated in the above-mentioned embodiments such as shape and size are one example, not particularly limited, and may be variously altered within a scope not substantially departing from the configuration of the present disclosure.

(1) In the embodiments of the present disclosure as described with reference to FIGS. 1 and 2, the image forming apparatus 100 is a color multifunction peripheral, but the present disclosure is not limited as such. The image forming apparatus need only form an image on the paper P. For example, the image forming apparatus may be a color printer. For another example, the image forming apparatus may be a monochrome copier.

(2) In the embodiments of the present disclosure as described with reference to FIGS. 1 to 3, the cooling tube 63 returns the liquid coolant sent from the heat radiating section 62 to the heat radiating section 62 by way of the heat receiving section 61*k*, the heat receiving section 61*y*, the heat receiving section 61*m*, and the heat receiving section 61*c*, but the present disclosure is not limited as such. The cooling tube 63 need only return the liquid coolant sent from the heat radiating section 62 to the heat radiating section 62 by way of at least one heat receiving section 61 of the heat receiving section 61*k*, the heat receiving section 61*y*, the heat receiving section 61*m*, and the heat receiving section 61*c*.

For example, one cooling tube 63 may return the liquid coolant sent from the heat radiating section 62 to the heat radiating section 62 by way of the heat receiving section 61*k* and the heat receiving section 61*y*, and another cooling tube 63 may return the liquid coolant sent from the heat radiating section 62 to the heat radiating section 62 by way of the heat receiving section 61*m* and the heat receiving section 61*c*.

For another example, the cooling unit may include four cooling tubes 63 (first through fourth cooling tubes). Specifically, the first cooling tube returns the liquid coolant sent from the heat radiating section 62 to the heat radiating section 62 by way of the heat receiving section 61*k*. The second cooling tube returns the liquid coolant sent from the heat radiating section 62 to the heat radiating section 62 by way of the heat receiving section 61*y*. The third cooling tube returns the liquid coolant sent from the heat radiating section 62 to the heat radiating section 62 by way of the heat receiving section 61*m*. The fourth cooling tube returns the liquid coolant sent from the heat radiating section 62 to the heat radiating section 62 by way of the heat receiving section 61*c*.

What is claimed is:

1. An image forming apparatus, comprising:

an image bearing member on which an electrostatic latent image is formed;

a development section configured to supply toner to the electrostatic latent image to form a toner image; and a cooling unit configured to cool the development section, wherein the cooling unit includes:

a heat receiving section configured to receive heat from the development section;

a heat radiating section configured to radiate the heat received by the heat receiving section; and a cooling tube configured to return a liquid coolant sent from the heat radiating section to the heat radiating section by way of the heat receiving section, the heat receiving section has a groove structure into which the cooling tube is fitted, and the groove structure has an arc shape with an opening in one direction in a cross-sectional view thereof.

2. The image forming apparatus according to claim 1, wherein a diameter of the arc shape is smaller than an outer diameter of the cooling tube by a predetermined length.

3. The image forming apparatus according to claim 1, wherein a span of the opening in a cross section of the heat receiving section is smaller than an outer diameter of the cooling tube.

4. The image forming apparatus according to claim 3, wherein the heat receiving section further includes a plurality of fixing members, the plurality of fixing members is arranged in a longitudinal direction of the heat receiving section with a gap therebetween, and each of the plurality of fixing members has the groove structure.

5. The image forming apparatus according to claim 3, wherein two fixing members among a plurality of fixing members are located on opposite end portions of the heat receiving section.

6. The image forming apparatus according to claim 4, wherein the heat receiving section further includes a guide member which establishes a position of the cooling tube, the guide member is located between one fixing member and another fixing member among the plurality of fixing members, and the cooling tube bends around the guide member.

7. The image forming apparatus according to claim 1, wherein the cooling tube is arranged such that the liquid coolant flows from an end portion on one side of the heat receiving section toward an end portion on an opposite side of the heat receiving section, is arranged to protrude from the end portion on the opposite side of the heat receiving section and bend in a protruding portion thereof, and is arranged such that the liquid coolant flows from the end portion on the opposite side of the heat receiving section toward the end portion on the one side of the heat receiving section.

8. The image forming apparatus according to claim 1, comprising a predetermined number of the image bearing member and the predetermined number of the development section, the predetermined number being two or more, wherein the heat receiving section is one member which receives heat from the predetermined number of the development section.

9. The image forming apparatus according to claim 1, wherein the cooling tube is made of elastic resin.

10. The image forming apparatus according to claim 1, wherein the cooling tube includes thermally conductive filler.

11. The image forming apparatus according to claim 1, wherein the heat receiving section is made of metal material, and the metal material includes at least one of aluminum and copper.

12. The image forming apparatus according to claim 1, wherein the development section includes a housing section housing the toner, an upper surface of the heat receiving section is in contact with a base surface of the housing section, and the groove structure is located on a base surface of the heat receiving section.

* * * * *